US008721871B1

(12) United States Patent
Dindi et al.

(10) Patent No.: US 8,721,871 B1
(45) Date of Patent: May 13, 2014

(54) HYDROPROCESSING LIGHT CYCLE OIL IN LIQUID-FULL REACTORS

(71) Applicant: E I Du Pont De Nemours and Company, Wilmington, DE (US)

(72) Inventors: Hasan Dindi, Wilmington, DE (US); Alan Howard Pulley, Lee's Summit, MO (US); Vincent Adam Kuperavage, Jr., Philadelphia, PA (US); Thanh Gia Ta, New Castle, DE (US)

(73) Assignee: E I du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 13/669,540

(22) Filed: Nov. 6, 2012

(51) Int. Cl.
*C10G 65/02* (2006.01)
*C10G 65/04* (2006.01)

(52) U.S. Cl.
CPC ..... *C10G 65/043* (2013.01); *C10G 65/02* (2013.01); *C10G 65/04* (2013.01); *C10G 2300/307* (2013.01); *C10G 2300/308* (2013.01)
USPC ..... 208/49; 208/100

(58) Field of Classification Search
USPC ..... 208/100, 49
See application file for complete search history.

(56) References Cited

U.S. PATENT DOCUMENTS 3,620,962 A 11/1971 Pfefferle
6,123,835 A 9/2000 Ackerson et al.
7,569,136 B2 8/2009 Ackerson et al.
7,794,585 B2 9/2010 Leonard et al.
2002/0121457 A1* 9/2002 Tsao et al. ..... 208/60
2006/0144756 A1* 7/2006 Ackerson et al. ..... 208/108
2009/0200201 A1* 8/2009 Chen ..... 208/15
2010/0116712 A1 5/2010 Dziabala et al.
2011/0005972 A1* 1/2011 Kim et al. ..... 208/65
2012/0205285 A1 8/2012 Dindi et al.
2012/0273390 A1 11/2012 Dindi et al.

OTHER PUBLICATIONS

Vasant P. Thakkar et al., LCO Upgrading a Novel Approach for Greater Added Value and Improved Returns, AM, 05-53, National Petrochemical & Refiners Association, UOP LLC., p. 1-15, 2005.

International Search Report, PCT/US2013/068208, Dated Mailed Mar. 2, 2014.

* cited by examiner

*Primary Examiner* — Prem C Singh
*Assistant Examiner* — Brandi M Doyle

(57) ABSTRACT

A process for the hydroprocessing of a low value light cycle oil (LCO) hydrocarbon feed to provide a high-value diesel-range product. The process comprises a hydrotreatment stage followed by a hydrocracking stage, each of which is conducted under liquid-full reaction conditions wherein substantially all the hydrogen supplied to the hydrotreating and hydrocracking reactions is dissolved in the liquid-phase hydrocarbon feed. Ammonia and other gases formed during hydrotreatment are removed in a separation step prior to hydrocracking. The LCO feed is advantageously converted to diesel in high yield with little loss of hydrocarbon to naphtha.

15 Claims, 1 Drawing Sheet

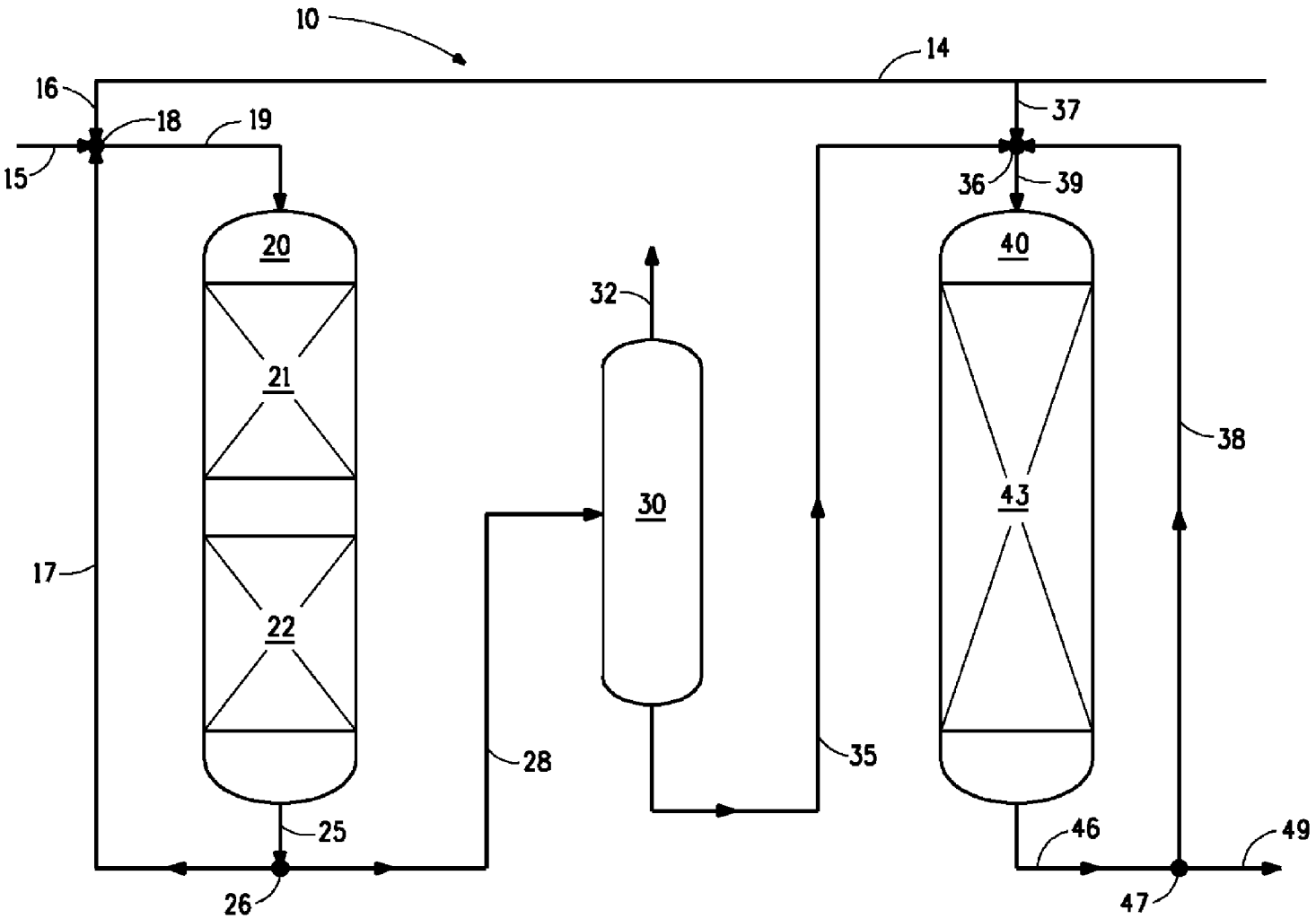
10
14
15
16
17
18
19
20
21
22
25
26
28
30
32
35
36
37
38
39
40
43
46
47
49

HYDROPROCESSING LIGHT CYCLE OIL IN LIQUID-FULL REACTORS

FIELD OF THE INVENTION

The present invention pertains to a process for hydroprocessing a hydrocarbon feed and more particularly to a process for hydroprocessing light cycle oil hydrocarbon feed in liquid-full reactors to selectively convert the light cycle oil to a diesel-range product.

BACKGROUND OF THE INVENTION

Global demand for diesel has risen quickly with increased growth of transportation fuels. At the same time, regulations on the properties of the transportation diesel have become more rigorous in order to mitigate environmental impact. European standards, for example, call for a density less than 860 kilograms per cubic meter (kg/m$^3$), a polycyclic aromatics content of less than 11 wt. % and a sulfur content of less than 10 part per million by weight (wppm) which is often referred to as ultra-low-sulfur-diesel, or ULSD. Future standards call for a density less than 845 kg/m$^3$.

There is a need for a broader range of hydrocarbon feeds to use as feedstocks for producing diesel, including ULSD. A refinery produces a number of hydrocarbon products having different uses and different values. It is desired to reduce production of or upgrade lower value products to higher value products. Lower value products include cycle oils which have historically been used as blend-stock for fuel oil. However, such oils cannot be directly blended into today's diesel fuels because of their high sulfur content, high nitrogen content, high aromatics content (particularly high polyaromatics), high density, and low cetane value.

Various hydroprocessing methods, such as hydrodesulfurization and hydrodenitrogenation, can be used to remove sulfur and nitrogen from a hydrocarbon feed. Additionally, hydrocracking, can be used to crack heavy hydrocarbons (high density) into lighter products (lower density) with hydrogen addition. However, high nitrogen content can poison a zeolitic hydrocracking catalyst, and hydrocracking conditions which are too severe can cause the formation of significant amounts of naphtha and lighter hydrocarbons which are considered lower value products.

Thakkar et al. in "LCO Upgrading A Novel Approach for Greater Value and Improved Returns" AM, 05-53, NPRA, (2005), propose a once-through hydrotreating and hydrocracking flow scheme for upgrading a light cycle oil (LCO) into a mixture of liquefied petroleum gas (LPG), gasoline and diesel products. Thakkar et al. disclose producing a low sulfur content diesel (ULSD) product. However, Thakkar et al. use traditional trickle bed reactors. Significant amounts of light gas and naphtha are produced in the disclosed hydrocracking process. The diesel product accounts for only about 50%, or less, of the total liquid product using LCO feed.

Leonard et al. in U.S. Pat. No. 7,794,585 disclose a process for hydrotreating and hydrocracking hydrocarbon feedstocks in a "substantially liquid phase" which is defined as the feed stream has a larger liquid phase than a gas phase. More specifically, hydrogen may be present in a gas phase up to 1000 percent of saturation. Leonard et al. teach such high amounts are needed so that as hydrogen is consumed, hydrogen is available from the gas phase. Thus, the Leonard et al. reaction system is a trickle bed.

Conventional three-phase (trickle bed) hydroprocessing units used for hydrotreating and high pressure hydrocracking require hydrogen from a vapor phase to be transferred into liquid phase where it is available to react with a hydrocarbon feed at the surface of the catalyst. These units are expensive, require large quantities of hydrogen, much of which must be recycled through expensive hydrogen compressors, and result in significant coke formation on the catalyst surface and catalyst deactivation.

U.S. Pat. No. 6,123,835, discloses a two-phase ("liquid-full") hydroprocessing system which avoids some the disadvantages of trickle bed systems.

U.S. Patent Application Publication 2012/0205285 discloses a two-stage process for targeted pretreatment and selective ring-opening in liquid-full reactors with a single recycle loop to convert heavy hydrocarbons and light cycle oils to liquid product having over 50% in the diesel boiling range.

Still, it is desirable to provide hydroprocessing systems which convert heavy hydrocarbon feeds, in particular LCO, to diesel in higher yield and/or quality.

SUMMARY OF THE INVENTION

The present invention provides a process for hydroprocessing a hydrocarbon feed, comprising: (a) contacting the hydrocarbon feed with hydrogen and a first diluent to form a first liquid feed, wherein hydrogen is dissolved in said first liquid feed, and wherein the hydrocarbon feed is a light cycle oil (LCO) having a polyaromatic content greater than 25% by weight, a nitrogen content greater than 300 parts per million by weight (wppw), and a density greater than 890 kg/m$^3$; (b) contacting the first liquid feed mixture with a first catalyst in a first liquid-full reaction zone to produce a first effluent; (c) recycling a portion of the first effluent for use as all or part of the first diluent in step (a); (d) separating ammonia and optionally other gases from the portion of first effluent not recycled, to produce a second effluent having a nitrogen content less than 100 wppm; (e) contacting the second effluent with hydrogen and a second diluent to produce a second liquid feed, wherein hydrogen is dissolved in said second liquid feed; (f) contacting the second liquid feed with a second catalyst in a second liquid-full reaction zone to produce a third effluent having a density less than 865 kg/m$^3$ at 15.6° C. and a polyaromatic content less than 11% by weight; (g) recycling a portion of the third effluent for use as all or part of the second diluent in step (e); and (h) taking the portion of the third effluent not recycled as the product stream.

The hydroprocessing reactions take place in the first and second liquid-full reaction zones. Liquid-full means that substantially all the hydrogen is dissolved in the liquid-phase hydrocarbon feed which surrounds the catalyst in the reaction zone.

In one embodiment, the present process further comprises (i) fractionating the product stream to recover at least the diesel fraction.

In another embodiment of the present process, the LCO in step (a) has a sulfur content of more than 500 wppm and the product stream in step (h) has a sulfur content of less than 50 wppm and preferably less than 10 wppm.

The process of the present invention advantageously converts LCO to a diesel-range product in high yield. There is little loss of hydrocarbon to lower value naphtha. The diesel thus made is of high quality and well suited for use in applications where physical property requirements are strict, such as transportation fuels.

BRIEF DESCRIPTION OF THE FIGURE

FIG. 1 is a flow diagram depicting the hydroprocessing of light cycle oil in liquid-full reactors according to one embodiment of the process of this invention.

DETAILED DESCRIPTION

The term "hydroprocessing" refers to any process that is carried out in the presence of hydrogen, including, but not limited to, hydrogenation, hydrotreating, hydrocracking, dewaxing, hydroisomerization, and hydrodearomatization.

The term "hydrotreating" refers to a process in which a hydrocarbon feed reacts with hydrogen, in the presence of a hydrotreating catalyst, to hydrogenate olefins and/or aromatics or remove heteroatoms such as sulfur (hydrodesulfurization), nitrogen (hydrodenitrogenation, also referred to as hydrodenitrification), oxygen (hydrodeoxygenation), metals (hydrodemetallation), asphaltenes, and combinations thereof.

The term "hydrocracking" refers to a process in which a hydrocarbon feed reacts with hydrogen, in the presence of a hydrocracking catalyst, to break carbon-carbon bonds and form hydrocarbons of lower average boiling point and/or lower average molecular weight than the starting average boiling point and average molecular weight of the hydrocarbon feed. Hydrocracking also includes ring opening of naphthenic rings into more linear-chain hydrocarbons.

The term "polyaromatic(s)" refers to polycyclic aromatic hydrocarbons and includes molecules with nucleus of two or more fused aromatic ring such as, for example, naphthalene, anthracene, phenanthracene and so forth, and derivatives thereof.

The hydroprocessing reactions of this invention take place in a liquid-full reaction zone. By "liquid-full" it is meant herein that substantially all of the hydrogen is dissolved in a liquid-phase hydrocarbon feed to a reaction zone wherein the feed contacts a catalyst.

The hydrocarbon feed in the process of the present invention is light cycle oil (LCO) and like material. Light cycle oil typically has a cetane index value less than 30, for example, a value in the range of about 15 to about 26; a polyaromatics content greater than 25% and commonly in the range of about 40% to about 60% by weight; a monoaromatics content greater than 10% and commonly in the range of about 15% to about 40% by weight; a total aromatics content greater than 50% and commonly in the range of about 60% to about 90% by weight; and, a density equal to or greater than 890 kg/m$^3$ (0.890 g/mL) measured at a temperature of 15.6° C. and usually greater than 900 kg/m$^3$ measured at a temperature of 15.6° C. Light cycle oil also typically has a nitrogen content greater than 300 parts per million by weight (wppm) and a sulfur content greater than 500 wppm. With the present process, a very high percentage of the LCO is upgraded to high quality diesel.

The first stage of the present process is a hydrotreatment. The fresh LCO hydrocarbon feed is contacted with hydrogen and a first diluent to form a single liquid-phase mixture (first liquid feed) in which the hydrogen is dissolved. The contacting operation to make the first liquid feed mixture, or the analogous second liquid feed mixture described herein after, may be performed in any suitable mixing apparatus known in the art. The first diluent may comprise, consist essentially of, or consist of a first recycle stream described herein after.

The first liquid feed mixture is contacted with a first catalyst in a first liquid-full reaction zone to produce a first effluent. The selection of first catalyst, which is a hydrotreating catalyst, and the operating conditions in the first liquid-full reaction zone, such as temperature, pressure and liquid hourly space velocity (LHSV), are designed to accomplish at least hydrodenitrification and polyaromatic saturation of the first liquid feed. Hydrodesulfurization will generally and desirably also take place at the same time. A portion of the first effluent is recycled for use as all or part of the first diluent in the first liquid feed.

The portion of first effluent not recycled is subjected to a separation step wherein ammonia from hydrodenitrification and optionally other gases such as hydrogen sulfide from hydrodesulfurization are separated to produce a second effluent which will become the feed to the second stage of the process. The second effluent will have a greatly reduced nitrogen and polyaromatic content compared to the fresh LCO feed. For example, the second effluent will generally have a nitrogen content less than 100 parts per million by weight (wppm), typically less than 10 wppm, and a polyaromatic content of less than 11% by weight. The second effluent will generally have a cetane index greater than that of the fresh LCO, for example, a cetane index that is greater than 30 but typically less than 40. The second effluent will also generally have a greatly reduced sulfur content relative to the fresh LCO, for example a sulfur content less than 50 wppm and preferably less than 10 wppm when the fresh LCO feed had a sulfur content greater than 500 wppm. Substantially no naphtha is made during the hydrotreating first stage and consequently the volume fraction of naphtha in the first or second effluent is low to nil.

In the second stage of the process, a hydrocracking stage, the second effluent is contacted with hydrogen and a second diluent to form a single liquid-phase mixture (second liquid feed) in which the hydrogen is dissolved. The diluent comprises, consists essentially of, or consists of a second recycle stream as described herein after. The second liquid feed mixture is contacted with a second catalyst in a second liquid-full reaction zone to produce a third effluent. The second catalyst, which is a hydrocracking catalyst, and the operating conditions in the second liquid-full reaction zone, such as temperature, pressure and liquid hourly space velocity (LHSV), are chosen to cause ring opening of the second liquid feed mixture and avoid cracking the feed to lighter (e.g. naphtha) fractions. The reactions in this stage cause a beneficial decrease in density and increase in cetane index relative to that of the second effluent. A portion of the third effluent is recycled for use as all or part of the second diluent in the second liquid feed.

The portion of third effluent not recycled is collected as the product stream. The product stream will have a density less than 865 kg/m$^3$, typically equal to or less than 860 kg/m$^3$, and preferably equal to or less than 845 kg/m$^3$ when measured at a temperature of 15.6° C. Also, the product stream will have a nitrogen content less than 100 wppm and generally less than 10 wppm, and a polyaromatic content less than 11% by weight. In addition, the product stream will typically have a cetane index greater than 35 and preferably greater than 40.

The product stream may be processed further as desired. For example, the product stream may be fractionated to a light (naphtha) fraction, a middle (diesel) fraction and a bottom (heavy) fraction. Preferably the diesel fraction is at least 60% by volume based on the total volume of the diesel and naphtha fractions. More preferably, the diesel fraction is at least 75% by volume based on the total volume of the diesel and naphtha fractions. Even more preferably, the diesel fraction is at least 88% by volume based on the total volume of the diesel and naphtha fractions. For the purpose of this invention, naphtha is defined as the distillate volume fraction less than 150° C.

and diesel is defined as the distillate volume fraction between 150° C. and 360° C. The heavy fraction boiling above 360° C. can be separated and optionally sent to a cracking unit to reduce molecular weight.

The first or second recycle streams provide at least a portion of the diluent to the first or second stages, respectively, of the process. For either of the first or second stages, the recycle ratio may be in a range of from about 1 to about 8, preferably at a recycle ratio of from about 1 to about 5. In addition to recycle, the diluent may comprise any other organic liquid that is compatible with the hydrocarbon feed and catalysts. When the diluent in either the first or second stage comprises an organic liquid in addition to the recycle stream, preferably the organic liquid is a liquid in which hydrogen has a relatively high solubility. The diluent may comprise an organic liquid selected from the group consisting of light hydrocarbons, light distillates, naphtha, diesel and combinations of two or more thereof. When the diluent comprises an organic liquid, the organic liquid is typically present in an amount of no greater than 50-80%.

The hydrogen demand and consumption across both stages of the process can be high. The total amount of hydrogen fed to the first and second stages of the process is greater than 100 normal liters of hydrogen per liter of feed (N l/l) or greater than 560 scf/bbl. Preferably, the total amount of hydrogen fed to the process is 200-530 N l/l (1125-3000 scf/bbl), more preferably 250-450 N l/l (1400-2500 scf/bbl). The combination of feed and diluent is capable of providing all of the hydrogen in the liquid phase, without need for gas phase for such high consumption of hydrogen. That is, the treatment zones are liquid-full reaction zones.

The first and second stage reactions are performed in separate reactors. Each of the first and second liquid-full reaction zones may independently comprise one reactor or two or more (multiple) reactors in series. Each reactor in either of the liquid-full reaction zones is a fixed bed reactor and may be of a plug flow, tubular or other design, which is packed with a solid catalyst and wherein the liquid feed is passed through the catalyst. Each reactor in each liquid-full zone may independently comprise a single catalyst bed or two or more (multiple) catalyst beds in series. Catalyst is charged to each bed. All first liquid-full reaction zone reactors and catalyst beds are in liquid communication and connected in series with each other. Likewise, all second liquid-full reaction zone reactors and catalyst beds are in liquid communication and connected in series with each other. In a column reactor or other single vessel containing two or more catalyst beds or between multiple reactors, the beds are physically separated by a catalyst-free zone. Preferably hydrogen can be fed between the beds to replace the depleted hydrogen content in the liquid phase. The fresh hydrogen dissolves in the liquid prior to contact with the catalyst thus maintaining the liquid-full reaction conditions. A catalyst-free zone in advance of a catalyst bed is illustrated, for example, in U.S. Pat. No. 7,569,136.

The separation of ammonia and optionally other gases to produce a second effluent can be performed in any suitable apparatus known in the art, including, for example, a low pressure separator. a high pressure separator or a fractionator.

The process conditions in the first and second liquid-full reaction zones, in other words the hydrotreating and hydrocracking conditions, respectively, can vary independently and range from mild to extreme. Reaction temperatures for either liquid-full reaction zone can range from about 300° C. to about 450° C., preferably from about 300° C. to about 400° C., and more preferably from about 340° C. to 400° C. Pressure in either liquid-full reaction zone can range from about 3.45 MPa (34.5 bar) to 17.3 MPa (173 bar), preferably from about 6.9 to 13.9 MPa (69 to 138 bar). A wide range of suitable catalyst concentrations may be used in the first and second stages. Preferably, the catalyst is about 10 to about 50 wt % of the reactor contents for each reaction zone. The liquid feed is provided at a liquid hourly space velocity (LHSV) of from about 0.1 to about 10 $hr^{-1}$, preferably, about 0.4 to about 10 $hr^{-1}$, more preferably about 0.4 to about 4.0 $hr^{-1}$. One skilled in the art can readily select suitable process conditions without any difficulty or undue experimentation.

The first catalyst is a hydrotreating catalyst and comprises a metal and an oxide support. The metal is a non-precious metal selected from the group consisting of nickel and cobalt, and combinations thereof, preferably combined with molybdenum and/or tungsten. The first catalyst support is a mono- or mixed-metal oxide, preferably selected from the group consisting of alumina, silica, titania, zirconia, kieselguhr, silica-alumina and combinations of two or more thereof. More preferably, the first catalyst support is alumina.

The second catalyst is a ring opening catalyst and also comprises a metal and an oxide support. The metal is also a non-precious metal selected from the group consisting of nickel and cobalt, and combinations thereof, preferably combined with molybdenum and/or tungsten. The second catalyst support is a zeolite, or amorphous silica, or a combination thereof.

Preferably the metal for both the first catalyst and the second catalyst is a combination of metals selected from the group consisting of nickel-molybdenum (NiMo), cobalt-molybdenum (CoMo), nickel-tungsten (NiW) and cobalt-tungsten (CoW).

The first and second catalysts may further comprise other materials including carbon, such as activated charcoal, graphite, and fibril nanotube carbon, as well as calcium carbonate, calcium silicate and barium sulfate.

Preferably, the first catalyst and the second catalyst are in the form of particles, more preferably shaped particles. By "shaped particle" it is meant the catalyst is in the form of an extrudate. Extrudates include cylinders, pellets, or spheres. Cylinder shapes may have hollow interiors with one or more reinforcing ribs. Trilobe, cloverleaf, rectangular- and triangular-shaped tubes, cross, and "C"-shaped catalysts can be used. Preferably a shaped catalyst particle is about 0.25 to about 13 mm (about 0.01 to about 0.5 inch) in diameter when a packed bed reactor is used. More preferably, a catalyst particle is about 0.79 to about 6.4 mm (about 1/32 to about 1/4 inch) in diameter. Such catalysts are commercially available.

Commercial sources of suitable catalysts are well known to those skilled in the art. Catalyst vendors included, for example, Albemarle, CRI Criterion and Haldor-Topsoe. Specific examples of hydrotreating catalysts include KF860 and KF848, from Albemarle. Specific examples of hydrocracking catalysts include KC2610 and KC3210, also from Albemarle.

The catalysts may be sulfided before and/or during use by contacting the catalyst with a sulfur-containing compound at an elevated temperature. Suitable sulfur-containing compound include thiols, sulfides, disulfides, $H_2S$, or combinations of two or more thereof. The catalyst may be sulfided before use ("pre-sulfiding") or during the process ("sulfiding") by introducing a small amount of a sulfur-containing compound in the feed or diluent. The catalysts may be pre-sulfided in situ or ex situ and the feed or diluent may be supplemented periodically with added sulfur-containing compound to maintain the catalysts in sulfided condition. The examples provide a pre-sulfiding procedure.

The process of the present invention can advantageously convert LCO, in high yield, to a diesel-range product. The diesel thus made is of high quality having a density of about 865 (0.865 g/mL) or less at a temperature of 15.6° C.; a polyaromatic content of less than 11 wt. %; a sulfur content of less than 50 wppm, preferably less than 10 wppm; and, a cetane index greater than 35. Diesel product is obtained by fractionating the total liquid product of the present process and recovering the diesel-range distillate.

It is common in a refinery setting to blend hydrocarbon stocks, such as diesel stocks with varying properties, to achieve a final product which is an optimum average of all properties. The diesel product produced by the present process is well suited for use in such blending operations.

DESCRIPTION OF THE FIGURE

FIG. 1 depicts a flow diagram for the hydroprocessing of light cycle oil in liquid-full reactors according to one embodiment of the process of the present invention. Certain detailed features of the proposed process, such as pumps and compressors, separation equipment, feed tanks, heat exchangers, product recovery vessels and other ancillary process equipment are not shown for the sake of simplicity and in order to demonstrate the main features of the process. Such ancillary features will be appreciated by one skilled in the art. It is further appreciated that such ancillary and secondary equipment can be easily designed and used by one skilled in the art without any difficulty or any undue experimentation or invention.

FIG. 1 depicts an exemplary hydroprocessing unit 10. Fresh hydrocarbon feed, in this case light cycle oil, is supplied via line 15 and contacted at mixing point 18 with hydrogen 16 from the main hydrogen head 14 and first diluent 17 to form the first liquid feed which is fed via line 19 to the top of hydrotreating reactor 20. The first liquid feed, in downward flow, contacts the first catalyst which, as shown, is comprised of two catalyst beds 21 and 22 disposed in sequence within hydrotreating reactor 20. The first effluent 25 exits the hydrotreating reactor and is split 26 into two portions. One portion of the first effluent is recycled as first diluent 17. The remaining portion of the first effluent not recycled 28 is sent to a separator 30 wherein ammonia and other gases are removed 32. Degassed second effluent 35 exits the separator and is contacted at mixing point 36 with hydrogen 37 and second diluent 38 to form a second liquid feed 39 which is fed to the top of hydrocracking reactor 40. The second effluent, in a downward flow, contacts the second catalyst which, as shown, is comprised of a single catalyst bed 43 within hydrocracking reactor 40. The third effluent 46 exits the hydrocracking reactor and is split 47 into two portions. One portion of the third effluent is recycled as second diluent 38. The remaining portion of the second effluent not recycled taken as the product stream 49. The product stream may be fractioned (distilled) elsewhere to separate a diesel fraction and (smaller) naphtha fraction.

As illustrated in FIG. 1, downflow of liquid feed through the reactors is preferred. However, an upflow process is also contemplated herein.

EXAMPLES

The following examples are presented to illustrate specific embodiments of the present invention and not to be considered in any way as limiting the scope of the invention.

All ASTM Standards referenced herein are available from ASTM International, West Conshohocken, Pa., www.astm.orq.

Amounts of sulfur, nitrogen and basic nitrogen are provided in parts per million by weight, wppm.

Sulfur content (total sulfur) was measured using ASTM D4294 (2008), "Standard Test Method for Sulfur in Petroleum and Petroleum Products by Energy Dispersive X-ray Fluorescence Spectrometry," DOI: 10.1520/D4294-08 and ASTM D7220 (2006), "Standard Test Method for Sulfur in Automotive Fuels by Polarization X-ray Fluorescence Spectrometry," DOI: 10.1520/D7220-06

Nitrogen content (total nitrogen) was measured using ASTM D4629 (2007), "Standard Test Method for Trace Nitrogen in Liquid Petroleum Hydrocarbons by Syringe/Inlet Oxidative Combustion and Chemiluminescence Detection," DOI: 10.1520/D4629-07 and ASTM D5762 (2005), "Standard Test Method for Nitrogen in Petroleum and Petroleum Products by Boat-Inlet Chemiluminescence," DOI: 10.1520/D5762-05.

Aromatic content, including mono aromatics and polyaromatics, was determined using ASTM D6591-1 entitled "Standard Test Method for Determination of Aromatic Hydrocarbon Types in Middle Distillates—High Performance Liquid Chromatography Method with Refractive Index Detection".

Boiling range distribution was determined using ASTM D2887 (2008), "Standard Test Method for Boiling Range Distribution of Petroleum Fractions by Gas Chromatography," DOI: 10.1520/D2887-08.

Density, specific gravity and API gravity were measured using ASTM Standard D4052 (2009), "Standard Test Method for Density, Relative Density, and API Gravity of Liquids by Digital Density Meter," DOI: 10.1520/D4052-09.

"API gravity" refers to American Petroleum Institute gravity, which is a measure of how heavy or light a petroleum liquid is compared to water. If API gravity of a petroleum liquid is greater than 10, it is lighter than water and floats; if less than 10, it is heavier than water and sinks. API gravity is thus an inverse measure of the relative density of a petroleum liquid and the density of water, and is used to compare relative densities of petroleum liquids.

The formula to obtain API gravity of petroleum liquids from specific gravity (SG) is:

$$\text{API gravity}=(141.5/SG)-131.5$$

Cetane index is useful to estimate cetane number (measure of combustion quality of a diesel fuel) when a test engine is not available or if sample size is too small to determine this property directly. Cetane index was determined by ASTM Standard D4737 (2009a), "Standard Test Method for Calculated Cetane Index by Four Variable Equation," DOI: 10.1520/D4737-09a.

"LHSV" means liquid hourly space velocity, which is the volumetric rate of the liquid feed divided by the volume of the catalyst, and is given in $hr^{-1}$.

"WABT" means weighted average bed temperature.

The experiments were performed in a pilot unit containing five fixed-bed reactors in series. Each reactor was of 19 mm (¾ inch) OD 316L stainless steel tubing. Reactors 1 and 2 were 49 cm in length and reactor 3 was 61 cm in length. Reactors 4 and 5 were either 49 cm in length (examples 2-4) or 61 cm in length (Comparative Example A). Catalyst was packed in the middle section of the reactor. Metal mesh was used to hold the catalyst in place and outside the metal mesh there was a layer of 1 mm glass beads at both ends. The ends of the reactors were fit with reducers to 6 mm (¼ inch).

Each reactor was placed in a temperature controlled sand bath in a 7.6 cm (3 inch) OD and 120 cm long pipe filled with fine sand. Temperature was monitored at the inlet and outlet of each reactor as well as in each sand bath. The temperature in each reactor was controlled using heat tapes wrapped around the 7.6 cm OD pipe and connected to temperature controllers.

Hydrogen was fed from compressed gas cylinders and the flow rates were measured using mass flow controllers. The hydrogen was injected and mixed with the combined fresh LCO feed and the recycle product stream before Reactor 1. The combined "fresh LCO/hydrogen/recycle product" stream flowed downwardly through a first temperature-controlled sand bath in a 6 mm OD tubing and then in an up-flow mode through Reactor 1. After exiting Reactor 1, additional hydrogen was injected in the effluent of Reactor 1 (feed to Reactor 2). The feed to Reactor 2 flowed downwardly through a second temperature-controlled sand bath in a 6 mm OD tubing and then in an up-flow mode through Reactor 2. After exiting Reactor 2, more hydrogen was dissolved in the effluent of Reactor 2 (feed to Reactor 3). The liquid feed to Reactor 3 and followed the same pattern. After exiting Reactor 3, the effluent was split into a recycle stream and a product effluent. The liquid recycle stream flowed through a piston metering pump to join a fresh LCO feed at the inlet of the first reactor.

The catalyst was pre-sulfided and stabilized prior to making the example run. Catalyst was dried overnight at 115° C. under a total flow of 210 standard cubic centimeters per minute (sccm) of hydrogen. The pressure was 1.7 MPa (17 bar). The catalyst-charged reactors were heated to 176° C. with a flow of charcoal lighter fluid through the catalyst beds. Sulfur spiking agent (1 wt % sulfur, added as 1-dodecanethiol) and hydrogen gas were introduced into the charcoal lighter fluid at 176° C. to start to pre-sulfide the catalysts. The pressure was 6.9 MPa (69 bar). The temperature in each reactor was increased gradually to 320° C. Pre-sulfiding was continued at 320° C. until a breakthrough of hydrogen sulfide ($H_2S$) at the outlet of the last reactor. After pre-sulfiding, the catalysts were stabilized by flowing a straight run diesel (SRD) feed through the catalyst beds at a temperature from 320° C. to 355° C. and at 6.9 MPa (1000 psig or 69 bar) for 10 hours.

The light cycle oil (LCO) used in these experiments was obtained from a commercial refiner and had the properties shown in Table 1.

TABLE 1

Properties of the Light Cycle Oil Used in the Examples

| Property | Unit | Value |
|---|---|---|
| Sulfur | wppm | 7726 |
| Nitrogen | wppm | 878 |
| Density at 15.6° C. (60° F.) | kg/m$^3$ | 947 |
| API Gravity | | 17.8 |
| Cetane Index | | 23 |
| Aromatic content | | |
| Monoaromatics | wt % | 18.2 |
| Polyaromatics | wt % | 55.2 |
| Total aromatics | wt % | 73.4 |
| Boiling Point Distribution | % | ° C. |
| IBP = Initial boiling point | IBP | 122 |
| | 5 | 199 |
| | 10 | 230 |
| | 20 | 249 |
| | 30 | 259 |
| | 40 | 272 |
| | 50 | 289 |
| | 60 | 299 |
| | 70 | 312 |
| | 80 | 335 |
| | 90 | 353 |
| | 95 | 368 |
| | 99 | 382 |
| FBP = Final boiling point | FBP | 390 |

TABLE 1-continued

Properties of the Light Cycle Oil Used in the Examples

Example 1

This example demonstrated the first stage of the present invention. Reactors 1-3 were equipped with a hydrotreating catalyst to accomplish hydrodenitrogenation (HDN), hydrodesulfurization (HDS) and hydrodearomatization (HDA). The catalyst, KF-860 (NiMo on γ-Al2O3 support) from Albemarle Corp., Baton Rouge, LA, was in the form of extrudates of a quadralobe about 1.3 mm diameter and 10 mm long. About 22 mL, 62 mL, and 96 mL of catalyst (180 mL total) were loaded into the first, second, and third reactor, respectively. Reactor 1 was packed with layers of 30 mL (bottom) and 30 mL (top) of glass beads. Reactor 2 was packed with a layer of 10 mL (bottom) and 11 mL (top) of glass beads. Reactor 3 was packed with a layer of 7 mL (bottom) and 3 mL (top) of glass beads.

Fresh LCO feed was pumped to Reactor 1 using a reciprocating pump at a flow rate ranging from 1 mL/minute to 3 mL/minute. Total hydrogen fed to the reactors ranged between 310 N l/l to 350 N l/l (1730 scf/bbl–2180 scf/bbl). Reactors 1-3 had a WABT ranging from 360° C. to 405° C. Pressure was 13.8 MPa (138 bar). The effluent from reactor 3 was split into a recycle stream and a product effluent. The liquid recycle stream flowed through a piston metering pump, to join a fresh hydrocarbon feed at the inlet of the first reactor. The recycle ratio ranged between 4 and 6. The LHSV ranged between 0.33 and 1 hr$^{-1}$.

The product effluent from reactor 3 was brought to ambient temperature and pressure. Dissolved gases were vented from the product by bubbling nitrogen through the liquid and the resulting degassed product (referred to as stage 1 product) was retained for use in subsequent examples. The properties of the stage 1 product are given in Table 2.

TABLE 2

Product Properties of Example 1

| | LCO Feed | Stage 1 Product |
|---|---|---|
| Monoaromatic | 18.2 | 31.9 |
| Polyaromatic | 55.2 | 1.8 |
| Total Aromatic | 73.4 | 33.7 |
| Sulfur (wppm) | 7726 | 211 |
| Nitrogen (wppm) | 878 | 1 |
| Density (kg/m$^3$, 20° C.) | 947 | 872 |
| Cetane Index | 23 | 36.8 |

Example 2

Demonstrated in this example is the second stage of the present invention wherein the stage 1 product from Example 1 is used as the feed.

Reactors 4 and 5 were filled with hydrocracking catalyst, KC2610 (NiW on a zeolite support) from Albemarle in the form of cylindrical extrudates about 1.5 mm in diameter and 10 mm long. Each reactor was filled with 60 mL of catalyst and contained a layer of 12 mL (bottom) and 24 mL (top) of glass beads. Hydrogen was injected only into the feed to reactor 4; effluent from reactor 4 flowed directly into reactor 5. The effluent from reactor 5 was split into a recycle stream and a product effluent. The liquid recycle stream flowed through a piston metering pump, to join the feed at the inlet of reactor 4.

The feed (stage 1 product from Example 1) was pumped to reactor 4 using a reciprocating pump at a flow rate of 1.5 mL/min for a LHSV of 0.75 $hr^{-1}$. Hydrogen was fed at 125 N l/l (710s cf/bbl). Pressure was 13.8 MPa (138 bar). The recycle ratio was 6. Runs were made at two different reaction temperatures. Reactors 4 and 5 had a WABT of 343° C. in one run and 360° C. in the other run. Properties of the feed and product from each reaction temperature are summarized in Table 3.

TABLE 3

Product Properties of Example 2

| | Feed | Product 343° C. | Product 360° C. |
|---|---|---|---|
| Monoaromatic (wt %) | 31.9 | 29.3 | 28.6 |
| Polyaromatic (wt %) | 1.8 | 9.5 | 10.7 |
| Total Aromatic (wt %) | 33.7 | 38.8 | 39.3 |
| Sulfur (wppm) | 211 | 5 | 4 |
| Nitrogen (wppm) | 1 | 1 | 1 |
| Density (kg/$m^3$, 20° C.) | 872 | 832 | 831 |
| Cetane Index | 36.8 | 42.1 | 37.6 |
| Naphtha (vol %) | — | 10 | 25 |

Example 3

Demonstrated in this example is the second stage of the present invention wherein the stage 1 product from Example 1 is fractionated prior to use as the feed. The reaction conditions are otherwise similar to Example 2

A portion of the stage 1 product from example 1 was charged into 3 L batch distillation column. The column contained 5 trays, a total condenser, and reflux splitter. The column was operated under a vacuum. An electric heating mantle was used to heat the column. The column operated at a 2:1 reflux ratio. The distillation was continued until the distillate had an average density of 850 kg/$m^3$. The bottoms from the batch distillation was used as the feed for the second stage of Example 3.

The feed (bottoms from the distillation) was pumped to reactor 4 using a reciprocating pump at a flow rate of 1.5 mL/min for a LHSV of 0.75 $hr^{-1}$. Hydrogen was fed at 125 N l/l (710 scf/bbl). Pressure was 13.8 MPa (138 bar). The recycle ratio was 6. Runs were again made at two different reaction temperatures. Reactors 4 and 5 had a WABT of 343° C. in one run and 360° C. in the other run. Properties of the feed (bottoms) and product from each reaction temperature are summarized in Table 4.

TABLE 4

Product Properties of Example 3

| | Feed (Bottoms) | Product 343° C. | Product 360° C. |
|---|---|---|---|
| Monoaromatic (wt %) | 43.5 | 31.5 | 29.4 |
| Polyaromatic (wt %) | 3.4 | 8.2 | 12.7 |
| Total Aromatic (wt %) | 47 | 39.7 | 42.1 |
| Sulfur (wppm) | 410 | 10 | 10 |
| Nitrogen (wppm) | 1 | 1 | 1 |
| Density (kg/$m^3$, 20° C.) | 890 | 847 | 829 |
| Cetane Index | 33.9 | 41.0 | 40.5 |
| Naphtha (vol %) | — | 5 | 25 |

Example 4

Demonstrated in this example is the use of a different type of hydrocracking catalyst in reactors 4 and 5. The reaction conditions are otherwise similar to example 3 including use of the same batch of bottoms as the feed.

Reactors 4 and 5 each contained 60 mL of an 'amorphous' catalyst, KF1023-1.5Q manufactured by Albemarle which is nickel/molybdenum on activated alumina in the form of a quadralobe extrudate about 1.5 mm in diameter. Catalyst pre-sulfiding and stabilizing was the same as for the other catalysts.

The feed (bottoms from the distillation as described in Example 3) was pumped to Reactor 4 using a reciprocating pump at a flow rate of 1.5 mL/min for a LHSV of 0.75/hr. Hydrogen was fed at 113 N l/l (636 scf/bbl). Pressure was 13.8 MPa (138 bar). The recycle ratio was 6. Reactors 4 and 5 had a WABT of 343° C. Properties of the feed (bottoms) and product from the 343° C. reaction temperature are summarized in Table 5.

TABLE 5

Product Properties of Example 4

| | Feed (Bottoms) | Product 343° C. |
|---|---|---|
| Monoaromatic (wt %) | 43.5 | 16.4 |
| Polyaromatic (wt %) | 3.4 | 0.7 |
| Total Aromatic (wt %) | 47 | 17.2 |
| Sulfur (wppm) | 410 | 3 |
| Nitrogen (wppm) | 1 | 1 |
| Density (kg/$m^3$, 20° C.) | 890 | 862 |
| Cetane Index | 33.9 | 40.0 |
| Naphtha (vol %) | — | 0 |

Example A

Comparative

Demonstrated in this comparative example is the difference in product profile produced when degassing to remove volatiles, in particular ammonia, is not performed prior to the hydrocracking reactors.

Reactors 1-3 are loaded with catalyst as described in Example 1. Reactors 4 and 5 were filled with KC2610 hydrocracking catalyst as described in Example 2, except in this case, each or reactors 4 and 5 was filled with 90 mL of catalyst and contained a layer of 10 mL (bottom) and 15 mL (top) of glass beads.

The reactors were all connected in sequence; there was no interruption after reactor 3 to degas. Also, there was only a single recycle loop. The effluent from reactor 5 was split into a recycle stream and a product effluent, and the liquid recycle stream flowed through a piston metering pump, to join the feed at the inlet of reactor 1. Hydrogen was injected into the feed stream prior to reactors 1-4 to resaturate the feed.

The feed (fresh LCO) was pumped to reactor 1 using a reciprocating pump at a flow rate of approximately 2.24 mL/minute for a targeted hydrotreating and hydrocracking LHSV of 0.75 $hr^{-1}$, respectively. Total hydrogen fed to the hydrotreating catalyst (reactors 1-3) was similar to Example 1 (360 N l/l). The total hydrogen fed to the hydrocracking catalyst (Reactors 4-5) was 100 N l/l (560 scf/bbl). Reactors 1-3 had a WABT of 360° C., while Reactors 4-5 had a WABT of 370° C. Pressure was 13.8 MPa (138 bar). The recycle ratio was 6. Conditions were maintained for 3 hours to assure that the system was lined-out. Properties of Example A product are summarized in Table 6 and compared to properties of inventive Example 2, 343° C. product.

TABLE 6

Product Properties of Example A

| | Example A Product | Example 2 343° C. Product |
|---|---|---|
| Monoaromatic (wt %) | 35.6 | 29.3 |
| Polyaromatic (wt %) | 2.9 | 9.5 |
| Total Aromatic (wt %) | 38.5 | 38.8 |
| Sulfur (wppm) | 46 | 5 |
| Nitrogen (wppm) | 1 | 1 |
| Density (kg/m$^3$, 20° C.) | 869 | 832 |
| Cetane Index | 36 | 42.1 |
| Naphtha (vol %) | 5 | 10 |

The data demonstrate the advantage of the present invention, with nitrogen removed before hydrocracking, compared to a similar reaction wherein nitrogen is not removed before hydrocracking. Although both methods substantially upgrade LCO without generating substantial amounts of naphtha, the inventive method provides important and significantly better results with regard to lower density and higher cetane index.

What is claimed is:

1. A process for hydroprocessing a hydrocarbon feed, comprising:

(a) contacting the hydrocarbon feed with hydrogen and a first diluent to form a first liquid feed, wherein hydrogen is dissolved in said first liquid feed, and wherein the hydrocarbon feed is a light cycle oil (LCO) having a polyaromatic content greater than 25% by weight, a nitrogen content greater than 300 parts per million by weight (wppm), and a density greater than 890 kg/m$^3$;

(b) contacting the first liquid feed mixture with a first catalyst in a first liquid-full reaction zone to produce a first effluent;

(c) recycling a portion of the first effluent for use as all or part of the first diluent in step (a);

(d) separating ammonia and optionally other gases from the portion of first effluent not recycled, to produce a second effluent having a nitrogen content less than 100 wppm;

(e) contacting the second effluent with hydrogen and a second diluent to produce a second liquid feed, wherein hydrogen is dissolved in said second liquid feed;

(f) contacting the second liquid feed with a second catalyst in a second liquid-full reaction zone to produce a third effluent having a density less than 865 kg/m$^3$ at 15.6° C. and a polyaromatic content less than 11% by weight;

(g) recycling a portion of the third effluent for use as all or part of the second diluent in step (e); and (h) taking the portion of the third effluent not recycled as a product stream;

wherein the first catalyst is a hydrotreating catalyst and the second catalyst is a ring opening catalyst, wherein the second catalyst comprises a non-precious metal and an oxide support, and wherein the product stream has a cetane index greater than 35.

2. The process of claim 1 further comprising: fractionating the product stream to recover at least a diesel fraction.

3. The process of claim 1 wherein the total amount of hydrogen fed to the process is 200-530 N l/l (1125-3000 scf/bbl).

4. The process of claim 1 wherein the total amount of hydrogen fed to the process is 250-450 N l/l (1400-2500 scf/bbl).

5. The process of claim 1 wherein the second effluent produced in step (d) has a nitrogen content less than 10 wppm.

6. The process of claim 1 wherein both the first liquid-full reaction zone and the second liquid-full reaction zone have, independently, a temperature in the range of about 300° C. to about 450° C., a pressure in the range of about 3.45 MPa (34.5 bar) to about 17.3 MPa (173 bar), and a liquid hourly space velocity (LHSV) of from about 0.1 $hr^{-1}$ to about 10 $hr^{-1}$.

7. The process of claim 1 wherein both the first liquid-full reaction zone and the second liquid-full reaction zone have, independently, a temperature in the range of about 340° C. to about 400° C., a pressure in the range of about 6.9 MPa (69 bar) to about 13.9 MPa (138 bar), and a LHSV in the range of about 0.4 $hr^{-1}$ to about 4 $hr^{-1}$.

8. The process of claim 1 wherein the product stream comprises at least 75% by volume diesel based on the total volume of diesel fraction and naphtha fraction.

9. The process of claim 1 wherein the product stream comprises at least 88% by volume diesel, based on the total volume of diesel fraction and naphtha fraction.

10. The process of claim 1 wherein the LCO in step (a) has a sulfur content of more than 500 wppm and the product stream in step (h) has a sulfur content of less than 50 wppm.

11. The process of claim 10 wherein the product stream in step (h) has a sulfur content of less than 10 wppm.

12. The process of claim 1 wherein the LCO in step (a) has a cetane index less than 30.

13. The process of claim 12 wherein the product stream in step (h) has a cetane index greater than 40.

14. The process of claim 1 wherein the non-precious metal is selected from the group consisting of nickel and cobalt, and combinations thereof.

15. The process of claim 1 wherein the non-precious metal is a combination of metals selected from the group consisting of nickel-molybdenum (NiMo), cobalt-molybdenum (CoMo), nickel-tungsten (NiW) and cobalt-tungsten (CoW).

* * * * *